United States Patent [19]

Lorenzini

[11] 4,258,605

[45] Mar. 31, 1981

[54] CLARINET BARREL WITH REMOVABLE THROAT

[76] Inventor: Robert A. Lorenzini, Box 91, Hancock, Mass. 01237

[21] Appl. No.: 71,590

[22] Filed: Aug. 31, 1979

[51] Int. Cl.[3] ..... G10D 9/00

[52] U.S. Cl. ..... 84/386; 84/382

[58] Field of Search ..... 84/380–386

[56] References Cited

U.S. PATENT DOCUMENTS

| | | | |
|---|---|---|---|
| 1,171,647 | 2/1916 | Reynolds | 84/386 |
| 2,802,387 | 8/1957 | Bushnell | 84/386 |
| 3,800,651 | 4/1974 | Small | 84/386 |

*Primary Examiner*—Lawrence R. Franklin

*Attorney, Agent, or Firm*—Richard A. Menelly; Francis X. Doyle

[57] ABSTRACT

A clarinet barrel having fixed internal dimensions is provided with a plurality of throat members having a fixed outer dimension for insertion within the clarinet barrel. The inner dimensions of the individual throats are varied in order to provide varying tonal qualities to the clarinet. The throat member can be fabricated from materials other than wood to provide further tonal qualities.

6 Claims, 4 Drawing Figures

CLARINET BARREL WITH REMOVABLE THROAT

BACKGROUND OF THE INVENTION

Clarinets and other woodwind instruments depend upon the internal volume of their complete assembly for obtaining particular tonal characteristics. Since clarinets offered by the same manufacturer may have different tonal qualities, to the ears of an expert, professional musicians quite often possess a plurality of instruments for obtaining various tones. A particular clarinet may be favored for example, for performing one musical piece whereas another clarinet having slightly different tonal properties, may be favored for performing a different musical piece.

Tuning barrels are commonly employed for slightly changing the pitch of a clarinet when tuning may become necessary. U.S. Pat. No. 2,323,138 describes a tuning barrel slidably attached to the clarinet mouthpiece for changing the effective length of the barrel to result in a variation in pitch.

Another method for varying the pitch of a clarinet is described in U.S. Pat. No. 3,800,651. The pitch variation is accomplished therein by altering the internal bore diameter of the clarinet barrel while keeping the barrel length constant.

Problems often occur in attempting to match a mouthpiece obtained from one manufacturer within an instrument obtained from another manufacture. A mismatch of only a few thousandths of an inch between the diameters of the barrel of an instrument and the mouthpiece of an instrument can noticeably affect the tuning pitch of the instrument in some instances. Since musicians often change mouthpieces on the same instrument it would be highly advantageous to provide for slight changes in the size and taper of the barrel of the instrument in order to satisfactorily adapt the instrument to each different mouthpiece.

The purpose of this invention is to provide means for varying the tonal properties of a clarinet over a wide range of individual preferences by inserting one of a plurality of removable barrel inserts having different internal volumes. Each individual barrel insert provides the same effect as a new and different instrument so that the expert musician can have an entire repertoire of tonal variations within a single instrument.

SUMMARY OF THE INVENTION

The invention comprises a removable barrel inserted between the mouthpiece of a clarinet and the body of the clarinet. The internal geometry of the barrel is adapted to receive a removable throat member. The internal volume of each of a plurality of throats varies to provide a corresponding variation in the tonal property of the clarinet as a whole.

One embodiment comprises a hardwood barrel with a hardwood throat. Other embodiments include a hardwood barrel with throats fabricated from a variety of materials such as metals, plastics, and hard rubber to provide variations to the tone quality of the instrument.

DESCRIPTION OF THE PREFERRED EMBODIMENT

Figure 1:
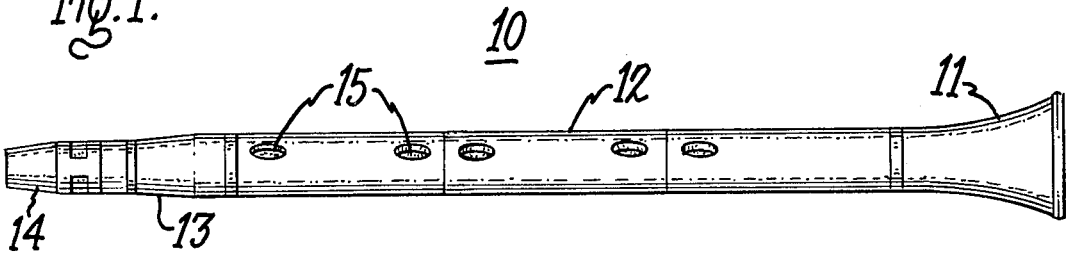
FIG. 1 is a side view of a clarinet containing the removable barrel of the invention.

FIG. 1 shows a clarinet 10 of the type consisting of an end bell or horn 11, a body 12, a barrel 13, and a mouthpiece 14. The body portion 12 can be fabricated of several removable sections, such as 12*a*, 12*b*, 12*c*, each having one or more keys 15. The barrel 13 is inserted between the body 12 and the mouthpiece 14, as shown.

Figure 2:
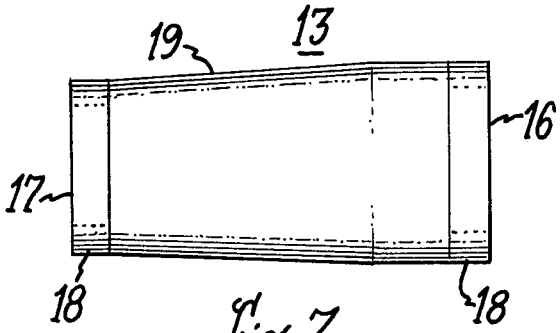
FIG. 2 is an enlarged side view of the barrel within the embodiment of FIG. 1.

The barrel 13 of the instant invention is shown in greater detail in FIG. 2 and comprises a front end 16, a back end 17, for interconnecting between the body and the mouthpiece and containing a metal ring 18 at each end for protection and decorative purposes. Although the body 19 of the barrel 13 is indicated to comprise instrument wood, such as grenadilla and rosewood, similar to that used for the body of the clarinet in FIG. 1, it is within the scope of this invention to fabricate the body 19 from metals, rubbers, and plastic.

Figure 3:
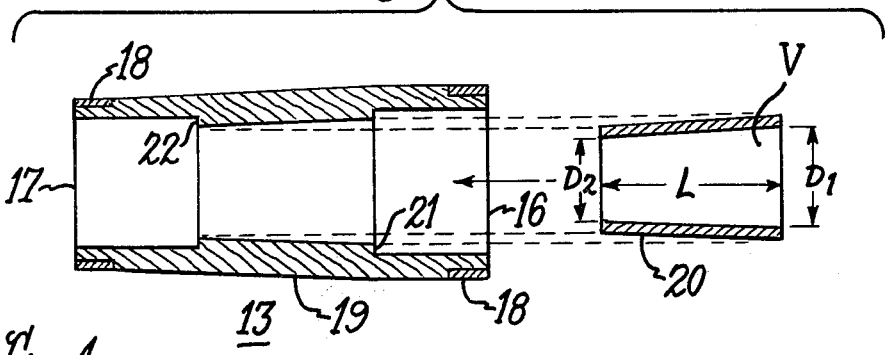
FIG. 3 is an enlarged side-sectional view of the barrel of FIG. 2 including a side-sectional view of a removable throat in isometric projection therefrom.
Figure 4:
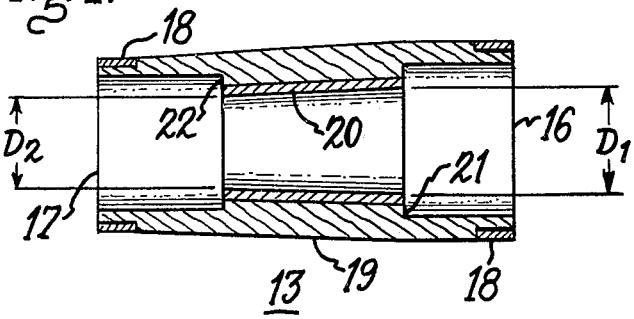
FIG. 4 is a side sectional view of the inventive barrel containing a throat.

One variation of the removable throat member 20 of this invention is shown in FIG. 3 prior to insertion within barrel 13. Barrel 13 contains a step or socket 22 on the back end 17 for receiving mouthpiece 14 and a step 21 on front end 16 for receiving a portion of the clarinet body 12 when the clarinet is completely assembled. As is apparent from FIG. 3, the present preferred embodiment of the throat 20 comprises a tapered or quasi cylindrical form having an exterior wall dimensioned to press-fit in the passageway between steps 21 and 22. In order to facilitate a press-fit and airtight connection between throat element 20 and barrel 13 the exterior surface of the throat is carefully machined to correspond to the inner geometry of the barrel between step 22 and 21. When the throat 20 is inserted within the barrel the tonal quality of the barrel 13 is then defined by the volume V within the throat 20, which has a front end diameter $D_1$, a back end diameter $D_2$ and a length l. Since the tone variations are achieved by varying the internal volume V a plurality of throat elements 20 can be provided having different internal volumes, while the exterior geometry of the throat 12 remains constant for close-fit insertion within the barrel 13.

Although this description is directed toward variations in the internal taper of the throat, it is to be clearly understood that the volume can also be altered by changing the shape of the internal portion of the barrel such as in a conical configuration. Throat member 20 can also be fabricated of an instrument wood or a metal when ringing tonal qualities are desired. Metals such as silver, nickel and tin alloys can be employed to provide unique tonal variation for a fixed inner volume V. Materials such as ebony, hard rubber, and ivory can also be employed for throat 20 to obtain a particular tonal quality. It is further within the contemplation of this invention to fabricate body 19 of barrel 13 of a synthetic resin, such as plastic or hard rubber and throat member 20 out of a similar material.

Although the barrel of the invention containing a plurality of removable throat members is disclosed for use within clarinets, this is by way of example only. The removable throat-barrel embodiment of this invention finds application within any type of woodwind instrument whatsoever.

I claim:

1. In a woodwind instrument, a barrel having an internal passageway with instrument receiving recesses at both ends thereof; and a plurality of throat members, each of which are adapted for individual insertion within said passageway, each of said throat members having an external configuration complementary to the internal configuration of said passageway and having a length corresponding to the length of said passageway, and each of said throat members having a different internal volume for providing a different tonal characteristic to said woodwind instrument when inserted into said passageway.

2. The combination of claim 1 wherein both said barrel and said throat member are made of wood.

3. The combination of claim 1 wherein both said barrel and said throat member are made of metal.

4. The combination of claim 1 wherein said barrel is made of wood and the throat member is made of metal.

5. The combination of claim 1 wherein said barrel is made of metal and the throat member is made of wood.

6. The combination of claim 1, 2, 3, 4, or 5 wherein the internal diameter of said throat member increases from one end to the other.

* * * * *